US007216720B2

(12) United States Patent
Zimmerman

(10) Patent No.: US 7,216,720 B2
(45) Date of Patent: May 15, 2007

(54) MULTI-STRING PRODUCTION PACKER AND METHOD OF USING THE SAME

(76) Inventor: C. Duane Zimmerman, 4553 Toyon Dr., Billings, MT (US) 59106

( * ) Notice: Subject to any disclaimer, the term of this patent is extended or adjusted under 35 U.S.C. 154(b) by 315 days.

(21) Appl. No.: 10/911,804

(22) Filed: Aug. 5, 2004

(65) Prior Publication Data

US 2006/0027378 A1 Feb. 9, 2006

(51) Int. Cl.
*E21B 33/122* (2006.01)
*E21B 33/12* (2006.01)

(52) U.S. Cl. ..... 166/387; 166/189

(58) Field of Classification Search ..... 166/179, 166/126, 129, 133, 142, 146, 149, 180, 183, 166/184, 185, 186, 188, 189
See application file for complete search history.

(56) References Cited

U.S. PATENT DOCUMENTS 2,605,637 A * 8/1952 Rhoades ..... 73/152.55
3,098,524 A * 7/1963 Brown ..... 166/313
3,103,813 A * 9/1963 Bourne, Jr. et al. ..... 166/264
3,143,968 A * 8/1964 Gallaway et al. ..... 166/106
3,326,292 A * 6/1967 Young et al. ..... 166/106
3,734,179 A * 5/1973 Smedley ..... 166/106
4,474,409 A 10/1984 Trevits et al.
4,505,332 A * 3/1985 Mills et al. ..... 166/120
4,678,040 A 7/1987 McLaughlin et al.
5,184,677 A 2/1993 Dobscha
5,226,485 A 7/1993 Dobscha et al.
5,411,098 A 5/1995 Schmidt et al.
5,479,991 A * 1/1996 Robison et al. ..... 166/387
5,501,279 A 3/1996 Garg et al.
5,509,757 A 4/1996 Croy
5,520,248 A * 5/1996 Sisson et al. ..... 166/250.02
6,082,455 A 7/2000 Pringle et al.
6,138,758 A * 10/2000 Shaw et al. ..... 166/265
6,325,144 B1 12/2001 Turley et al.
6,609,567 B2 8/2003 Ingram et al.
6,629,566 B2 10/2003 Liknes
6,761,222 B2 * 7/2004 Wilson ..... 166/387

* cited by examiner

*Primary Examiner*—David Bagnell
*Assistant Examiner*—David Andrews
(74) *Attorney, Agent, or Firm*—Antoinette M. Tease

(57) ABSTRACT

A production packer comprising a packer body, a flat plate, a sealing element, production tubing, water overflow tubing, gas vent tubing, pump cable pack-off tubing, and an optional pressure transducer port. The flat plate is welded onto the top of the packer body. The sealing element is bonded to the outside of the packer body. In the preferred embodiment, the packer body is a steel pipe, and the flat plate is made of steel. The packer is placed inside a production casing, and the diameter of the sealing element is greater than the diameter of the production casing. The sealing element is made out of a material that is durable enough to withstand the pressures associated with a production packer, flexible enough to fit inside the production casing, and elastic enough to create a seal between the packer body and the production casing.

13 Claims, 2 Drawing Sheets

MULTI-STRING PRODUCTION PACKER AND METHOD OF USING THE SAME

BACKGROUND OF THE INVENTION

1. Field of the Invention

The present invention relates to the field of production packers for oil and gas mining, and more particularly, for coal bed natural gas production.

2. Description of the Related Art

Coal bed natural gas is an important facet of the nation's energy mix (1). Coal bed natural gas currently constitutes approximately seven percent of the nation's natural gas production, and it is expected to increase in importance as an energy source (1). Natural gas is clean-burning and can be used as a boiler fuel, vehicle fuel, and heating fuel (1). Coal bed natural gas is often produced at shallow depths with large volumes of water (1). Coal bed natural gas production can occur within and outside areas of conventional oil and gas production (1).

A production packer is a device that is used to isolate the annulus and anchor or secure the bottom of the production tubing string (2). The purposes of a typical production packer include isolating well fluids and pressures, separating producing zones to prevent fluid and pressure contamination, aiding in forming the annular volume required for gas lift or subsurface hydraulic pumping systems, limiting well control to the tubing at the surface, and holding well servicing fluids in the casing annulus (3).

Various production packer designs have been developed for use in different contexts, depending on the wellbore geometry and the production characteristics of the reservoir fluids (2). Most existing production packers are designed for use in connection with reservoirs that are at least 2000 feet deep. Sophisticated design elements, primarily involving the sealing element, have been developed to accommodate the higher pressures and temperatures that accumulate at such depths. Conventional packers are typically installed using cement or other materials pumped into an inflatable sealing element (4). Alternatively, the packer is set in place against the production casing using mechanical setting devices. In the latter instance, the sealing element is compressed either by set down weight or tension.

One of the problems with using conventional packers for production at shallower depths is that they are not cost-effective. Many of the features that have been developed for high-depth, high-pressure and high-temperature applications are simply not necessary in the shallower applications. Another problem with using conventional packers for coal bed natural gas production is that they do not address the problems associated with diminishing water levels above the coal seams. In coal bed natural gas production, the coal seams are dewatered to cause desorption of the gas molecules. Removal of the water, however, can lead to collapse of the coal seams due to the presence of fractures within the coal seams themselves.

Accordingly, it is an object of the present invention to provide a cost-effective production packer for use in connection with shallower reservoirs (typically in the range of 500 to 3000 feet). It is a further object of the present invention to provide a production packer design that allows multiple seams of coal to be dewatered and produced simultaneously. It is a further object of the present invention to maintain a constant head of water over each coal seam. These objects are accomplished by equipping the packer with separate production, gas vent and water overflow strings, as well as a submersible pump.

BRIEF SUMMARY OF THE INVENTION

The present invention is a production packer comprising a packer body, a flat plate, a sealing element, production tubing, water overflow tubing, gas vent tubing, and pump cable pack-off tubing. The flat plate is welded onto the top of the packer body and has at least four pipe connections. The sealing element is bonded to the outside of the packer body. In the preferred embodiment, the packer body is a steel pipe, and the flat plate is made of steel. The packer is placed inside a production casing, and the diameter of the sealing element is greater than the diameter of the production casing. The sealing element is made out of a material that is durable enough to withstand the pressures associated with a production packer, flexible enough to fit inside the production casing, and elastic enough to create a seal between the packer body and the production casing. In the preferred embodiment, the sealing element is made of rubber.

The production casing is installed inside a wellbore and perforated at intervals corresponding roughly to a set of upper and lower coal seams. The packer is positioned between the set of upper and lower coal seams. At the bottom of the production casing is a casing sump and an electric submersible pump. Water enters the production casing through the perforated intervals, and there is a surface water discharge line at the top of the wellbore. The production tubing string allows water to be pumped from the casing sump up through the production packer and to the surface water discharge line.

The water entering the production casing through the perforated intervals creates a water column associated with the set of upper coal seams and a water column associated with the set of lower coal seams. The water overflow tubing extends upward above the uppermost coal seam and downward into the lower water column. Gravity causes water from the upper water column to travel through the water overflow tubing and down to the casing sump.

Gas also enters the production casing through the perforated intervals and creates a gas column associated with the set of upper coal seams and a gas column associated with the set of lower coal seams. There is a gas sales line at the top of the wellbore. The gas vent tubing extends from the lower gas column to the upper gas column or all the way to the gas sales line. The gas vent tubing allows gas that is desorbed from the lower coal seams below the packer to be vented to the gas sales line.

A pump cable runs from the surface of the wellbore through the pump cable pack-off tubing and down to the submersible pump. The pack-off tubing is sealed around the cable on top of the packer to prevent any hydraulic communication between the upper and lower coal seams.

The present invention optionally includes a pressure transducer port. This option allows the volume of the lower water column to be adjusted. In this embodiment, a pressure transducer cable runs from the surface of the wellbore through the pressure transducer port and down to a pressure transducer that is located in the vicinity of the submersible pump. The pressure transducer measures the amount of pressure induced by the lower water column, and the pressure measurements are conveyed to a pump controller located at the surface of the wellbore via the pressure transducer cable. The pump controller engages and disengages the submersible pump based on preset control parameters.

The present invention includes a method of adjusting the volume of the upper water column either by increasing or decreasing the length of the water overflow tubing or by moving the packer up or down the wellbore and thereby respositioning the water overflow tubing in relation to the perforated interval that corresponds to the upper water column.

REFERENCE NUMBERS

Figure 1:
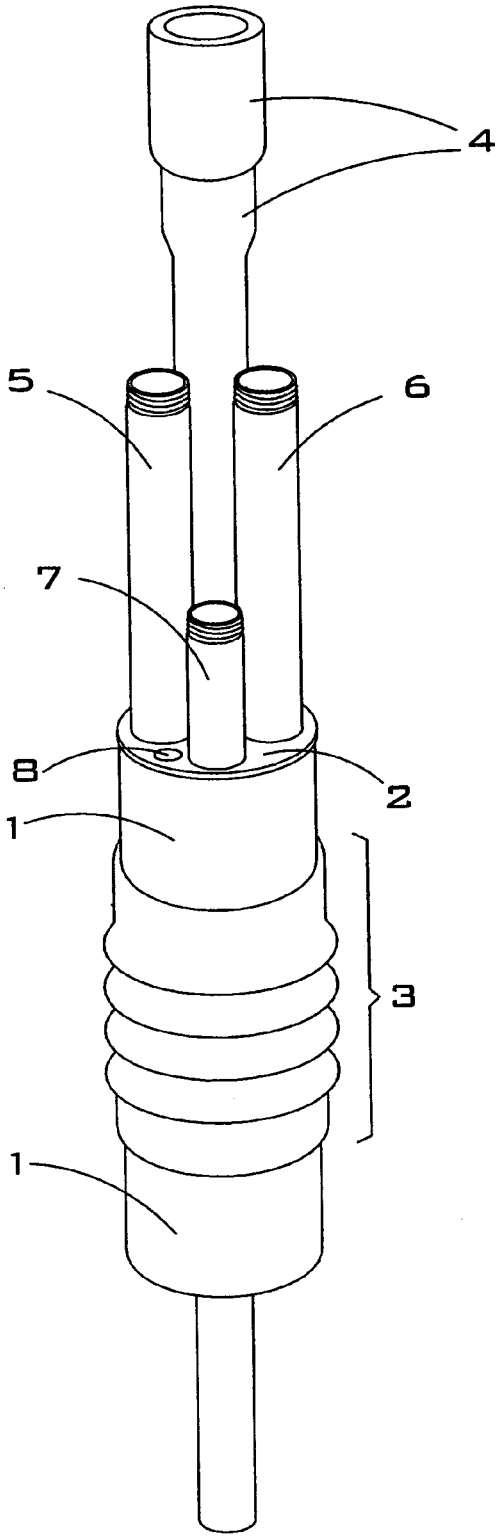
FIG. 1 is a front perspective view of the present invention.

1 Packer body
2 Flat plate
3 Packer sealing element
4 Production tubing
5 Water overflow tubing
6 Gas vent tubing
7 Pump cable pack-off tubing
8 Pressure transducer port
9A Upper coal seams
9B Lower coal seam
10A Electric submersible pump
10B Electric submersible pump cable
11 Casing sump
12 Gas column
13 Water column
14 Gas sales line
15 Water discharge line
16 Production casing
17 Perforated interval

DETAILED DESCRIPTION OF INVENTION

The present invention is a retrievable production packer designed to allow multiple seams of coal to be dewatered and produced, while maintaining a constant head of water over each coal seam. The packer design of the present invention comprises a packer body preferably made out of steel pipe with a flat plate welded onto the top of the pipe and a sealing element bonded to the outside of the pipe. The sealing element is preferably made out of rubber, but it can be made out of any material that is sufficiently durable to withstand the pressures associated with operating a production packer, sufficiently flexible so that the packer sealing element can be compressed against the packer body when the packer is inserted into the production casing, and sufficiently elastic so that the packer sealing element will expand outward against the production casing to form a seal.

The plate has four different pipe connections welded into it. The first pipe connection is for the production tubing string, the second pipe connection is for the water overflow tubing string, the third pipe connection is for the gas vent tubing string, and the fourth pipe connection is for the submersible pump cable pack-off tubing string.

The packer of the present invention is intended to be used in wells that are drilled to produce coal bed natural gas. The packer is placed between two or more seams of coal. The packer sealing element creates a seal between the packer and the production casing, which surrounds the production packer.

Figure 3:
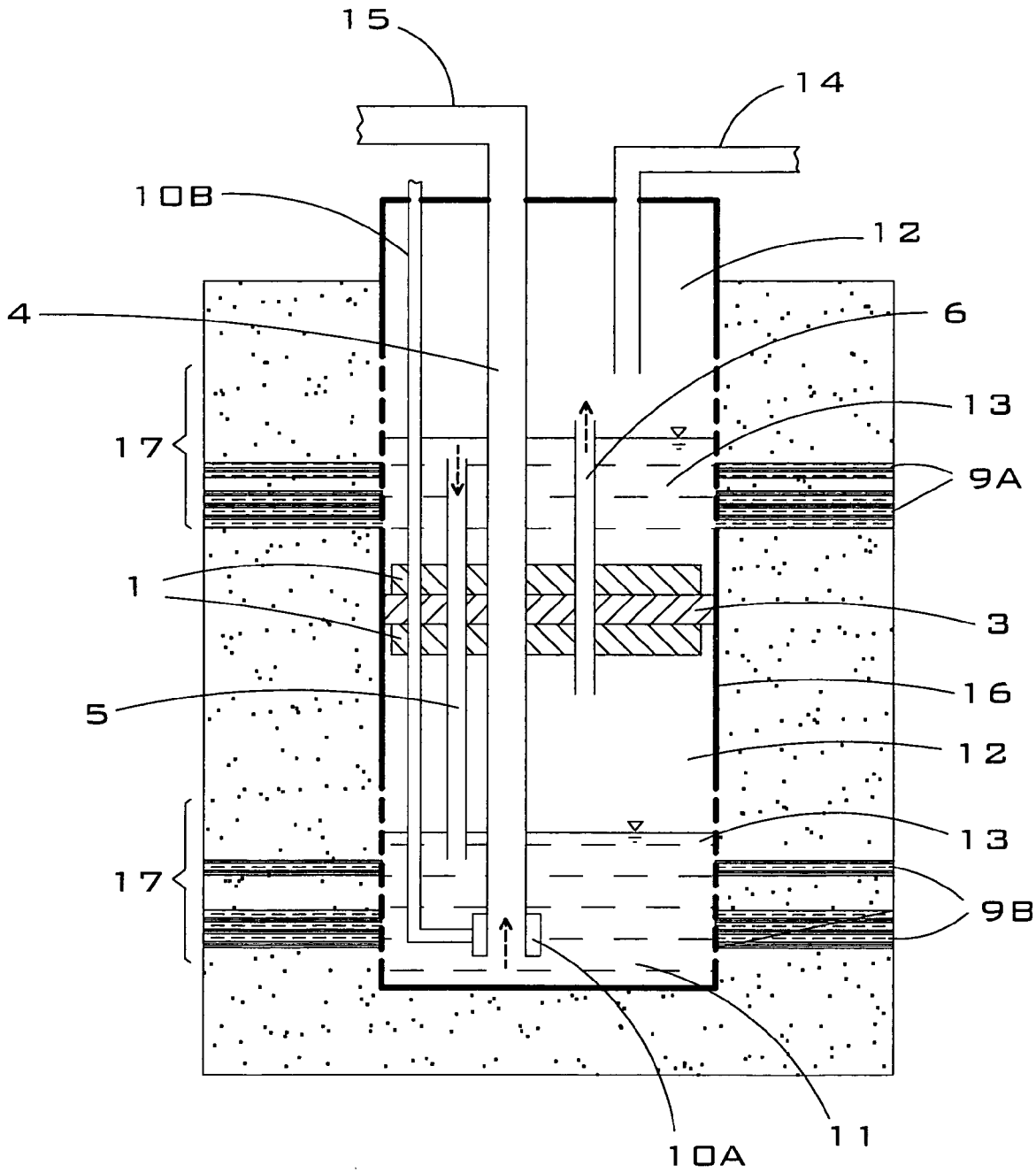
FIG. 3 is a schematic drawing of the present invention in operation.

FIG. 1 is a front perspective view of the present invention. This figure shows the packer body 1, which in this embodiment is a section of steel pipe, on top of which is attached a flat plate 2, which is preferably made out of steel as well. The packer sealing element 3 is preferably made out of a rubber and is bonded to the outside of the packer body 1. The flat plate 2 includes four pipe connections. The first pipe connection is for the production tubing string 4. This string of tubing allows water to be pumped from the casing sump portion of the wellbore up through the packer and to the surface water discharge line. The casing sump and water discharge line are shown in FIG. 3.

The second pipe connection is for the water overflow tubing 5. In operation, the packer is positioned below the uppermost coal seam in the wellbore with the water overflow tubing 5 extending above the uppermost coal seam in the wellbore. The packer sealing element 3 creates a mechanical seal between the packer and the production casing (not shown in FIG. 1). This seal prevents water or gas from moving via the casing from either above or below the packer. It also causes the water level across the upper coal seam to build up and gravity feed into the water overflow tubing 5, which delivers the water down to the casing sump (shown in FIG. 3).

The third pipe connection is for the gas vent tubing 6. The purpose of the gas vent tubing is to allow gas that is desorbed from the lower coal seams below the packer to be vented to the surface gas sales line (shown in FIG. 3).

The fourth pipe connection is for the pump cable pack-off tubing 7. The pump cable pack-off tubing 7 allows the pump cable to be installed through the packer down to an electric submersible pump (shown in FIG. 3) that is located in the casing sump. The pack-off tubing 7 is sealed around the cable on top of the packer, which prevents hydraulic communication between the upper and lower coal seams.

The present invention also includes an optional pressure transducer port 8. If used, the pressure transducer acts as a conduit for a pressure transducer cable (not shown) that is attached to a pressure transducer (not shown). The pressure transducer is located in the vicinity of the electric submersible pump 10A. The pressure transducer measures the amount of pressure induced by the water column 13 and conveys that information to a pump controller (not shown) on the surface. The pump controller will either engage or disengage the submersible pump 10A based on preset control parameters. In this manner, the volume of the lower water column can be adjusted through the use of the pressure transducer and pump controller.

The volume of the upper water column can be adjusted in one of two ways. First, the length of the water overflow tubing 5 can be increased or decreased to achieve the desired water level. Second, the entire packer can be moved up or down the wellbore, which will have the effect of repositioning the water overflow tubing 5 in relation to the perforated interval 17 that corresponds to the upper water column.

In the wellbore, the entire packer is surrounded by a production casing (not shown in FIG. 1). The production casing is a large-diameter steel pipe that is cemented in place during the construction process to stabilize the wellbore (2). As noted above, the packer sealing element forms a seal between the packer body and the production casing. Prior to installing the production packer within the wellbore, the production casing is perforated at perforation intervals 17 to allow water and gas from the coal seams 9A, 9B to enter the production casing 16.

Figure 2:
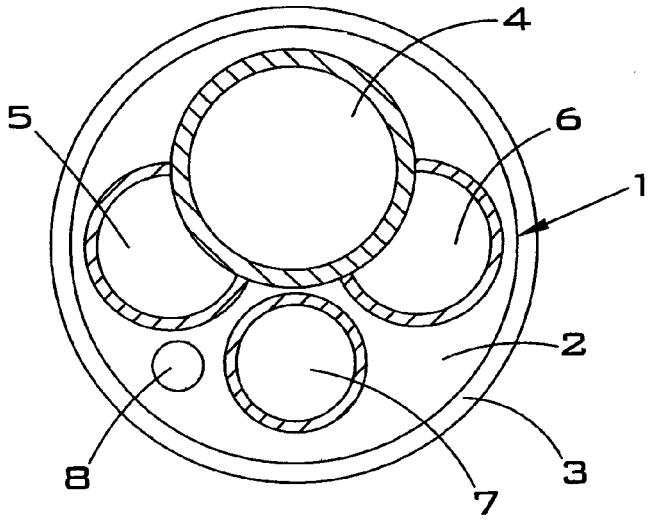
FIG. 2 is a top view of the present invention.

FIG. 2 is a top view of the present invention. This figure shows many of the same components as in FIG. 1, namely, the packer body 1, the flat plate 2, the packer sealing element 3, the production tubing 4, the water overflow tubing 5, the gas vent tubing 6, the pump cable pack-off tubing 7, and the pressure transducer port 8. In order to create an effective seal, the diameter of the packer sealing element 3 is greater than the inner diameter of the production casing.

Due primarily to the simplicity of the packer sealing element design, the packer of the present invention is relatively small as compared to other packer designs with more complicated sealing mechanisms. In the preferred embodiment, the production casing is approximately seven inches in diameter, and the outer diameter of the packer body is approximately five and one-half inches. The thickness of the wall of the packer body is approximately 0.275 inches.

FIG. 3 is a schematic drawing of the present invention in operation. This figure shows the packer body 1 and the packer sealing element 3 in relation to the production casing 16. It also shows the casing sump 11, which is located at the bottom of the wellbore, and the electric submersible pump 10*a*, which is located at the bottom of the production tubing 4. An electric submersible pump cable 10*b* runs from the submersible pump 10*a* through the pump cable pack-off tubing (not shown) to the surface.

This figure shows also the positioning of the packer between the upper coal seams 9A and the lower coal seams 9B. There is a water column 13 and a gas column 12 associated with both the upper and lower coal seams. As described above in connection with FIG. 1, the water overflow tubing 5 extends upward above the upper coal seams 9A into the water column 13 associated with the upper coal seams. The water overflow tubing 5 extends downward into the water column 13 associated with the lower coal seams 9B. The length of the water overflow tubing 5 can vary to increase or decrease water levels in the gas columns 13, which results in an increase or decrease in the hydraulic pressure exerted on the coal seams. An increase in hydraulic pressure generally decreases gas production, whereas a decrease in hydraulic pressure generally increases gas production.

As the coal seams are dewatered, water collects in both the water column 13 associated with the lower coal seams 9B and the water column 13 associated with the upper coal seams 9A. The electric submersible pump 10*a* pumps the water from the casing sump 11 at the bottom of the wellbore up through the production tubing 4 and out through the water discharge line 15 at the surface. The water overflow tubing 5 ensures that the upper coal seam is dewatered by allowing the water to flow through the packer down to the lower coal seam. The lower and upper coal seams are dewatered simultaneously by pumping the water from the casing sump 11 to the surface. Maintaining the water columns 13 associated with both the upper and lower coal seams 9A, 9B exerts hydraulic pressure on the coal seams, which prevents closure of the natural fractures and cleats inherent in the coal seams. The arrows indicate the direction in which the water travels, namely, down the water overflow tubing 5 and up the production tubing 4.

The gas vent tubing 6 runs from the gas column 12 associated with the lower coal seams 9B to the gas column 12 associated with the upper coal seams 9A. Alternatively, the gas vent tubing 6 can run all the way to the surface and out through the gas sales line 14, rather than terminating in the gas column 12 of the upper coal seams. As shown in FIG. 3, the gas is vented from the lower gas column to the upper gas column through the gas vent tubing and then out through the gas sales line 14 at the surface. The direction in which the gas travels is indicated by the upward arrow extending out of the gas vent tubing 6.

As is clear from the above description, the packer of the present invention is superior to existing packer technology for use in coal bed natural gas production because it solves the problem of closure of the coal seam fractures during production, and it allows multiple seams of coal to be dewatered and produced simultaneously. Furthermore, its relatively simple and compact design makes the packer of the present invention cost-effective for production at shallow depths. As the importance of coal bed natural gas to the nation's energy mix increases, the ability of the present invention to increase the efficiency of coal bed natural gas production will become critical.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

REFERENCES (1) *Handbook on Coal Bed Methane Produced Water,* Ch. 2 (Introduction to Coal Bed Methane), p. 2-1 (Arthur Langhus Layne, LLC, 1999-2002), available online at www.all-llc.com/CBM/BU/index.htm.

(2) *Schlumberger Oilfield Glossary* (2003), available online at www.glossary.oilfield.slb.com.

(3) L. Douglas Patton, *Petroleum Engineering Handbook,* Ch. 4 (Production Packers), p. 4-1 (Society of Petroleum Engineers, 1987).

(4) Gary Ingram, et al., U.S. Pat. No. 6,609,567 (Aug. 26, 2003), column 1, lines 40-42.

I claim:

1. A production packer comprising a packer body, a flat plate that is immovably attached to the packer body, a sealing element, production tubing, water overflow tubing, gas vent tubing that is used solely for the purpose of venting gas from below the packer to above the packer, and pump cable pack-off tubing, wherein water flows downward through the water overflow tubing.

2. The production packer of claim 1, wherein the flat plate comprises four pipe connections, wherein one pipe connection is for the production tubing, one pipe connection is for the water overflow tubing, one pipe connection is for the gas venting tubing, one pipe connection is for the pump cable pack-off tubing, and wherein the sealing element is bonded to the outside of the packer body.

3. The production packer of claim 2, wherein the packer is placed inside a production casing, wherein the production casing has an inner and an outer diameter, wherein the production casing is installed inside a wellbore, wherein the diameter of the packer sealing element is greater than the inner diameter of the production casing prior to installation of the packer inside the production casing, wherein the packer sealing element is comprised of a material that is both compressible and elastic, wherein the packer sealing element compresses to create a seal between the packer and the production casing, wherein the production casing is perforated at intervals corresponding roughly to a set of upper and lower coal seams located in the wellbore, wherein the packer is positioned between the set of upper and lower coal seams, wherein the production casing comprises a casing sump, wherein the casing sump is located at the bottom of the production casing, wherein water enters the production casing through the perforated intervals, wherein there is a surface water discharge line at the top of the wellbore, wherein the production tubing string allows water to be pumped from the casing sump up through the production packer and to the surface water discharge lines, and wherein water from both the upper and lower coal seams is pumped to the surface through the same production tubing.

4. The production packer of claim 3, wherein the water entering the production casing through the perforated intervals creates a water column associated with the set of upper coal seams and a water column associated with the set of lower coal seams, wherein the water overflow tubing extends upward above the uppermost coal seam, wherein the water overflow tubing extends downward into the lower water column, wherein gravity causes water from the upper water column to travel through the water overflow tubing and down to the casing sump.

5. The production packer of claim 3, wherein gas enters the production casing through the perforated intervals and creates a gas column associated with the set of upper coal seams and a gas column associated with the set of lower coal seams, wherein the gas vent tubing extends from the lower gas column to the upper gas column, wherein there is a gas sales line at the top of the wellbore, wherein the gas vent tubing allows gas that is desorbed from the lower coal seams below the packer to be vented to the gas sales line.

6. The production packer of claim 3, wherein gas enters the production casing through the perforated intervals and creates a gas column associated with the set of upper coal seams and a gas column associated with the set of lower coal seams, wherein there is a gas sales line at the top of the wellbore, wherein the gas vent tubing extends from the lower gas column to the gas sales line, and wherein the gas vent tubing allows gas that is desorbed from the lower coal seams below the packer to be vented through the gas sales line.

7. The production packer of claim 3, wherein there is an electric submersible pump located in the casing sump, wherein a pump cable runs from the surface of the wellbore through the pump cable pack-off tubing and down to the submersible pump, wherein the pack-off tubing is sealed around the cable on top of the packer to prevent any hydraulic communication between the upper and lower coal seams, and wherein the submersible pump pumps water from both the upper and lower coal seams to the surface.

8. The production packer of claim 7, further comprising a pressure transducer port, wherein a pressure transducer cable runs from the surface of the wellbore through the pressure transducer port and down to a pressure transducer that is located in the vicinity of the submersible pump, wherein the pressure transducer measures the amount of pressure induced by the lower water column, wherein the pressure measurements are conveyed to a pump controller located at the surface of the wellbore via the pressure transducer cable, wherein the pump controller engages and disengages the submersible pump based on preset control parameters.

9. The production packer of claim 3, wherein the diameter of the production casing is approximately seven inches.

10. The production packer of claim 1, wherein the sealing element is comprised of a durable, flexible and elastic material.

11. The production packer of claim 1, wherein the outer diameter of the packer body is approximately five and one-half inches.

12. A method of adjusting the volume of an upper water column, wherein a production packer comprises a packer body, a flat plate that is immovably attached to the packer body, a sealing element, production tubing, water overflow tubing, gas vent tubing, and pump cable pack-off tubing, wherein water flows downward through the water overflow tubing;

wherein the flat plate comprises four pipe connections, wherein one pipe connection is for the production tubing, one pipe connection is for the water overflow tubing, one pipe connection is for the gas venting tubing, and one pipe connection is for the pump cable pack-off tubing, and wherein the sealing element is bonded to the outside of the packer body; and wherein the packer is placed inside a production casing, wherein the production casing has an inner and an outer diameter, wherein the production casing is installed inside a wellbore, wherein the diameter of the packer sealing element is greater than the inner diameter of the production casing prior to installation of the packer inside the production casing, wherein the packer sealing element is comprised of a material that is both compressible and elastic, wherein the packer sealing element compresses to create a seal between the packer and the production casing, wherein the production casing is perforated at intervals corresponding roughly to a set of upper and lower coal seams located in the wellbore, wherein the packer is positioned between the set of upper and lower coal seams, wherein the production casing comprises a casing sump, wherein the casing sump is located at the bottom of the production casing, wherein water enters the production casing through the perforated intervals, wherein there is a surface water discharge line at the top of the wellbore, wherein the production tubing string allows water to be pumped from the casing sump up through the production packer and to the surface water discharge line, and wherein water from both the upper and lower coal seams is pumped to the surface through the same production tubing:

comprising increasing or decreasing the length of the water overflow tubing to achieve the desired water level.

13. A method of adjusting the volume of an upper water column, wherein a production packer comprises a packer body, a flat plate that is immovably attached to the packer body, a sealing element, production tubing, water overflow tubing, gas vent tubing, and pump cable pack-off tubing, wherein water flows downward through the water overflow tubing;

wherein the flat plate comprises four pipe connections, wherein one pipe connection is for the production tubing, one pipe connection is for the water overflow tubing, one pipe connection is for the gas venting tubing, and one pipe connection is for the pump cable pack-off tubing, and wherein the sealing element is bonded to the outside of the packer body; and wherein the packer is placed inside a production casing, wherein the production casing has an inner and an outer diameter, wherein the production casing is installed inside a weilbore, wherein the diameter of the packer sealing element is greater than the inner diameter of the production casing prior to installation of the packer inside the production casing, wherein the packer sealing element is comprised of a material that is both compressible and elastic, wherein the packer sealing element compresses to create a seal between the packer and the production casing, wherein the production casing is perforated at intervals corresponding roughly to a set of upper and lower coal seams located in the wellbore, wherein the packer is positioned between the set of upper and lower coal seams, wherein the production casing comprises a casing sump, wherein the casing sump is located at the bottom of the production casing, wherein water enters the production casing through the perforated intervals, wherein there is a surface water discharge line at the top of the wellbore, wherein the production tubing string allows water to be pumped from the casing sump up through the production packer and to the surface water discharge line, and wherein water from both the upper and lower coal seams is pumped to the surface through the same production tubing;

comprising moving the packer up or down the welibore and thereby respositioning the water overflow tubing in relation to the perforated interval that corresponds to the upper water column.

* * * * *